United States Patent [19]

Longworth

[11] 4,033,714

[45] July 5, 1977

[54] GASEOUS FUEL BURNERS

[75] Inventor: Alfred Longworth, Wembley, England

[73] Assignee: Radiation Limited, London, England

[22] Filed: May 5, 1975

[21] Appl. No.: 574,523

Related U.S. Application Data

[62] Division of Ser. No. 350,780, April 13, 1973, Pat. No. 3,897,198.

[30] Foreign Application Priority Data

Apr. 17, 1972 United Kingdom ..... 17691/72
Oct. 18, 1972 United Kingdom ..... 47926/72

[52] U.S. Cl. ..... 431/354; 48/180 F; 239/403; 239/405; 126/350 R

[51] Int. Cl.[2] ..... F23D 13/40

[58] Field of Search ..... 431/351, 353, 354, 185; 239/403, 405, 406, 132.3, 428.5; 417/171, 194, 197; 48/180 C, 180 F

[56] References Cited

UNITED STATES PATENTS

| | | | |
|---|---|---|---|
| 536,945 | 4/1895 | Avery | 48/180 F |
| 738,537 | 9/1903 | Gwynn | 431/354 |
| 794,545 | 7/1905 | Phillips | 431/354 |
| 798,647 | 9/1905 | Welch | 431/354 |
| 914,193 | 3/1909 | Schumacher | 48/180 C |
| 1,006,324 | 10/1911 | Werner | 431/353 |
| 1,322,999 | 11/1919 | Bester | 431/351 |
| 1,497,591 | 6/1924 | Robert | 431/178 |
| 2,222,822 | 11/1940 | Nordehsson | 431/353 |
| 3,368,547 | 2/1968 | Hale | 126/350 R |
| 3,385,356 | 5/1968 | Dalin | 122/367 R |

FOREIGN PATENTS OR APPLICATIONS

| | | |
|---|---|---|
| 348,639 | 5/1931 | United Kingdom |
| 730,290 | 5/1955 | United Kingdom |
| 358,092 | 10/1931 | United Kingdom |
| 364,783 | 1/1932 | United Kingdom |
| 1,180,718 | 2/1970 | United Kingdom |
| 1,119,532 | 7/1968 | United Kingdom |
| 894,693 | 4/1962 | United Kingdom |

*Primary Examiner*—Carroll B. Dority, Jr.
*Attorney, Agent, or Firm*—Brisebois & Kruger

[57] ABSTRACT

A gaseous fuel mixture burner which includes a mixer device into which gas is injected so as to provide a gaseous vortex formation within the mixer, air being drawn into the device and mixed with the gas by the low pressure region created within the vortex.

19 Claims, 15 Drawing Figures

GASEOUS FUEL BURNERS

Figure 1:
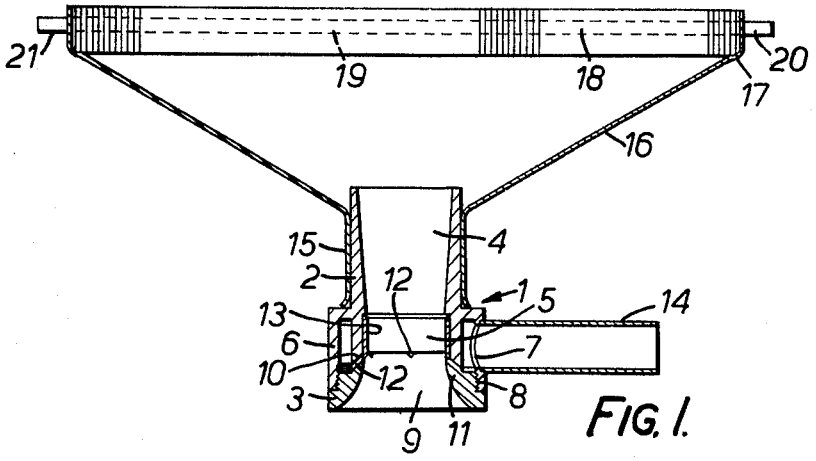

This application is a division of application Ser. No. 350,780 filed Apr. 13, 1973 and now U.S. Pat. No. 3,897,198.

This invention relates to gaseous fuel burners that is to say burners in which the fuel is burnt in gaseous form although the fuel may be stored in liquid or gaseous form. The invention also has particular but not exclusive reference to gaseous fuel burners for gas-fired water heaters which term is intended to include the so-called instantaneous water heaters and the heating units, usually referred to as boilers, incorporated in gas-fired central heating systems.

It is an object of the present invention to provide a gaseous fuel burner with a mixer device able to produce, for the burner, a gaseous fuel mixture of gas and air in which the ratios of the volumes of gas and air approach the ideal stoichiometric ratios.

According to the present invention, a mixer device for mixing first and second fluids comprises a hollow vessel having two open ends and a longitudinal axis, the vessel incorporating a header portion having an inlet, the portion being formed of at least two parts having engaging surfaces in one of which surfaces is formed a plurality of grooves which extend from the interior of said header and terminate in orifices positioned to permit first fluid admitted to said inlet to enter the vessel between the open ends thereof, the grooves being orientated to direct the one fluid into the vessel in a helical motion about the said axis, and directed towards one end of te vessel, whereby a low pressure zone is created within the helix adjacent said axis so enabling entry of the second fluid into the vessel via the other end thereof.

Preferably, each groove lies in a direction that is both tangential to a cylinder drawn about said axis and inclined towards said one end of said vessel.

The header may be of annular form.

The burner may incorporate a diffuser head adapted to provide the large number of flame ports necessary to secure a desired flame height at a specified thermal rating. The diffuser head may comprise an assembly of finned pipes, the spaces between th fins and the pipes constituting the flame ports. Alternatively, the diffuser head may comprise a porous metallic structure through which conduits pass to convey the cooling fluid. The structure has a plurality of apertures that constitute the flame ports. The diffuser head may be a double-walled structure having a multiplicity of transverse fuel passageways, coolant being circulated between the double walls.

Preferably, there is located in the duct a mixer device comprising a hollow open-ended vessel having a longitudinal axis and an arrangement including one or more orifices for a combustible gas, the or each orifice being positioned so as to permit entry of the gas into the vessel between the open ends thereof and in which the arrangement is such as to impart a helical motion to the gas about the longitudinal axis with a component of motion directed towards the burner outlet, the helical motion creating a vortex within the vessel with a low pressure zone in the vicinity of the axis, the zone enabling the entry of air into the vessel for intimate mixing with the combustible gas.

The mixer device may include an arrangement comprising a number of fuel supply pipes each of which passes into the vessel through the wall thereof, each pipe having at least one of the orifices formed in it.

Another form of mixer device includes two parts that have mating surfaces, the orifices being formed between the surfaces. In such a construction there may be included a further, resilient part that is mounted between the two parts in such manner that rate of flow of fuel through the orifices is determined by the degree of compression of the further part, and in which the two parts are adjustable in position relatively to one another in order to vary the degree of compression of the further part.

The internal contour of the vessel may be of venturi form, the longitudinal axis of the vessel corresponding with that of the venturi. The orifices may be positioned at the throat of the venturi.

The gaseous fuel burner may include a burner head with an inlet adapted to receive the output of the mixer device and so arranged relatively thereto in such manner that further air is entrained in the output of the mixer device as that output enters the burner head inlet.

The burner may have several such inlets each fed from a separate mixer device.

Alternatively, the duct may be fitted to a mixer in which combustible gas is mixed with air supplied by a blower, fan or other powered device, or a mixer in which the flow of air is induced by means of an exhaust fan or similar mechanism.

It will be appreciated that the diffuser head constitutes a heat exchanger, heat being extracted from the diffuser head by the fluid, for example water, circulated therethrough.

The circulatory path may be joined to a further heat exchanger located above the burner.

In one particular embodiment, the burner may form part of a heat exchanger assembly for a gas-fired water heater, the assembly including the further heat exchanger which is located in close proximity to, and above, the diffuser head so as to define therewith, at least partially, a gaseous fuel mixture combustion zone.

In the case of the water heater, the diffuser head is water cooled and the circulatory path forms part of the water heating circuit of the water heater.

The invention also provides a mixer device comprising an opne-ended cylindrical mixing chamber and means at or adjacent one end of the chamber for inspirating one of the fluids into the chamber, the means comprisng a supply header for the other fluid, the header being of generally annular form and having a surface coaxial with the longitudinal axis of the chamber and facing the other end of the mixing chamber, and a series of orifices in the surface and in communication with the interior of the header, the orifices being so arranged that, in use, fluid entering the chamber from the orifices has imparted to it a helical motion about the longitudinal axis and directed towards the other end of the chamber, the arrangement being such that, in use, the one fluid is drawn into the chamber through and externally of the supply header.

The mixer device just defined is not restricted to use with gaseous fuel burners and may be used for mixing fluids other than gaseous fuel and air.

The supply header may be positioned coaxially within the mixing chamber, the arrangement being such that there is formed an annular passageway between the header and the chamber for the entry into the latter of fluid drawn externally of the header.

Alternatively, the supply header may be received in the one end of the mixing chamber, the curved wall of the latter being gapped or formed with holes at locations close to the orifices to permit the entry into the latter of fluid drawn externally of the header.

The supply header may comprise inner and outer tubular members nested together to form the header. At one end the members have surfaces which coact to provide the orifices in the end surface. Either inner or outer member may have a shoulder grooved on its outer or inner face respectively and which co-operates with a plain face on the other member to form the orifices.

Figure 2:
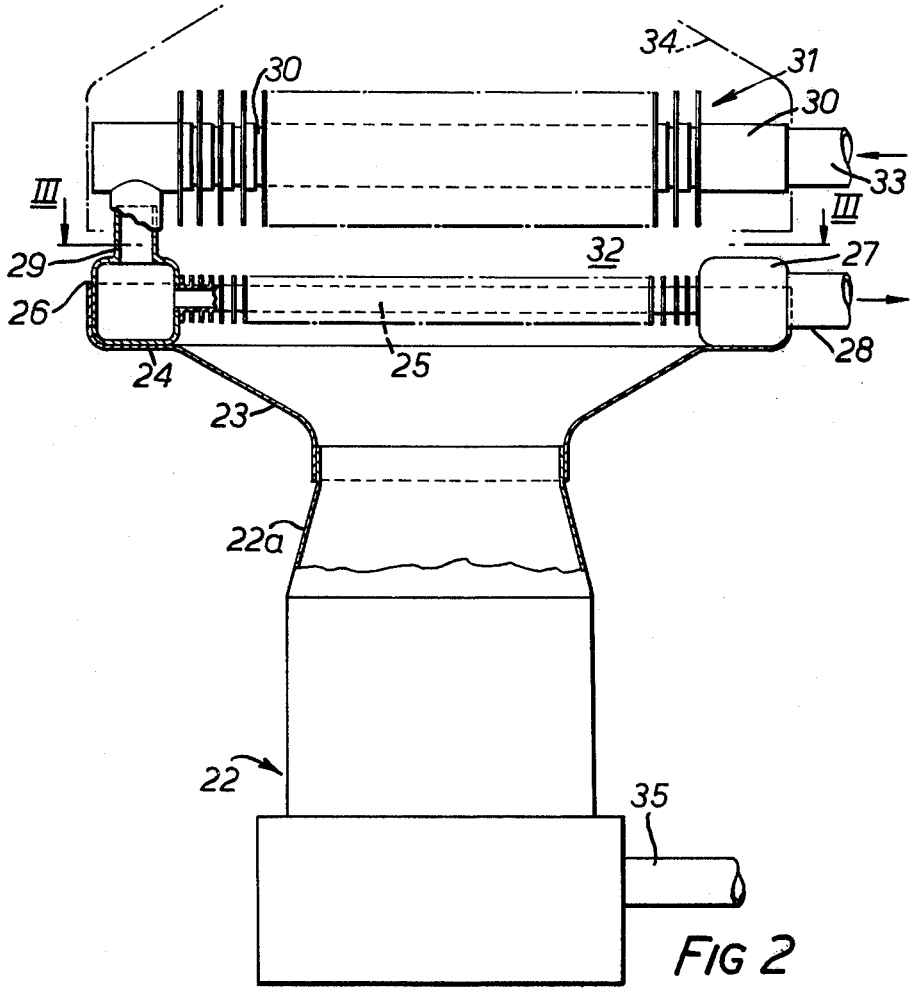
Figure 3:
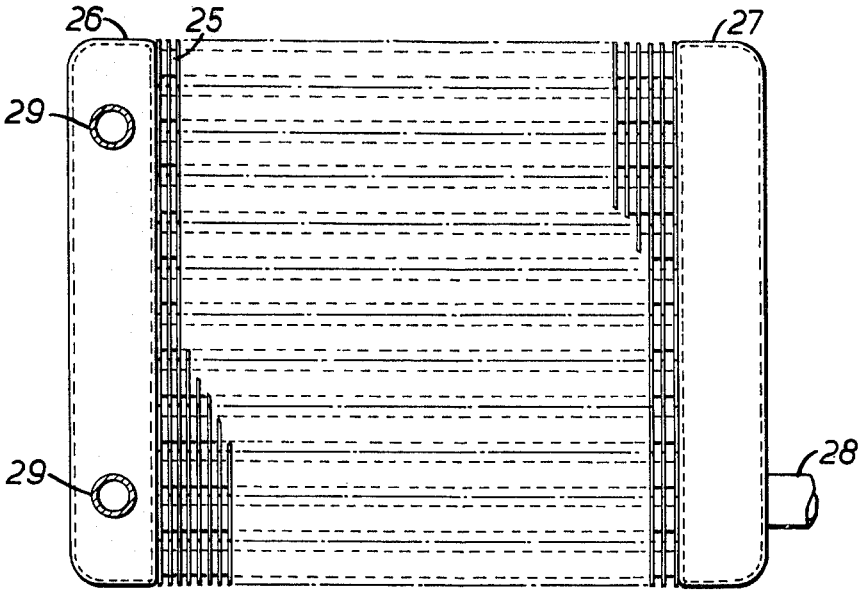
Figure 4:
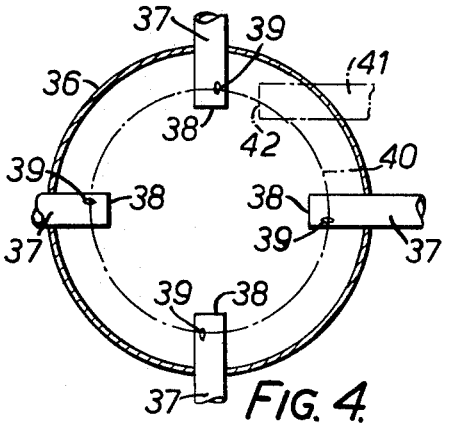
Figure 6:
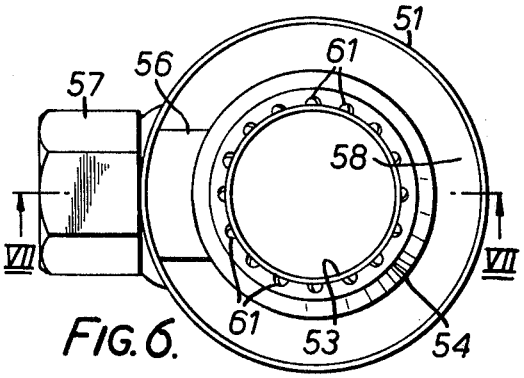
Figure 5:
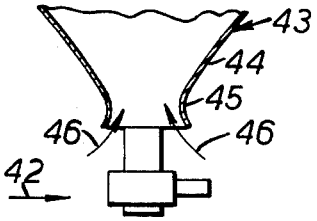
Figure 7:
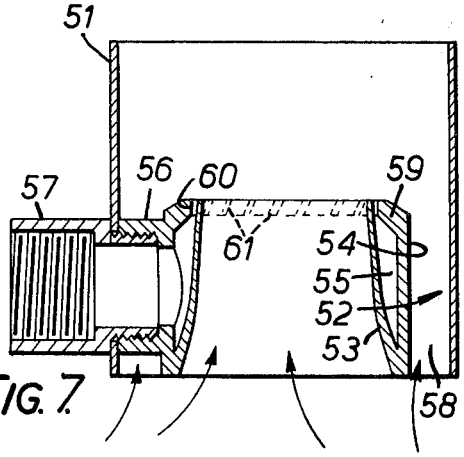
Figure 8:
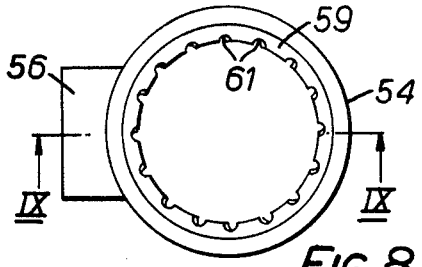
Figure 9:
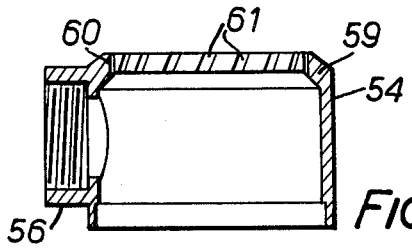
Figure 10:
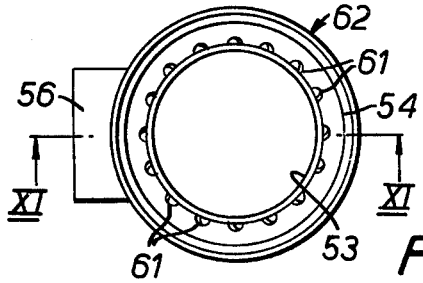
Figure 11:
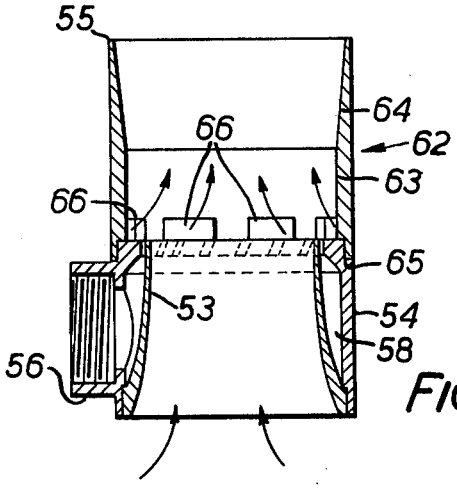
Figure 12:
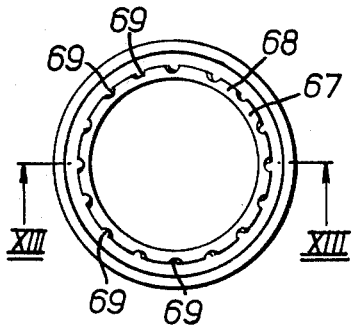
Figure 13:
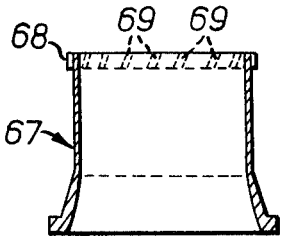
Figure 14:
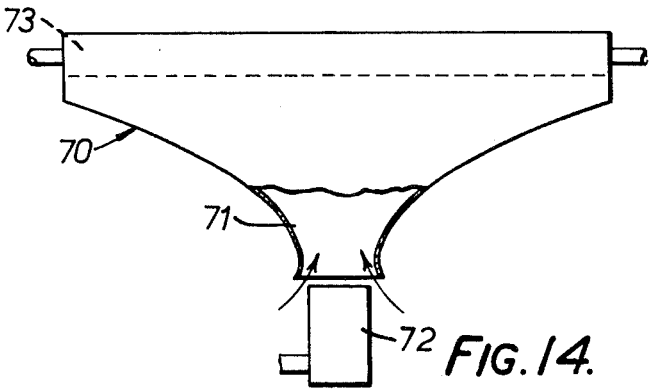
Figure 15:
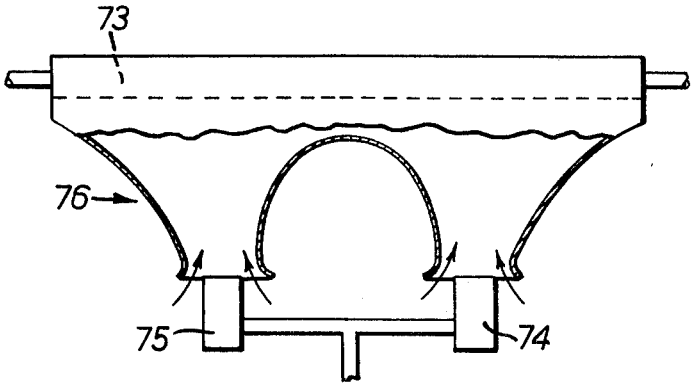

By way of example only, gaseous fuel burners embodying the invention, mixer devices for use therewith, and a heat exchanger assembly incorporating the burner and suitable for a gas-fired water heater will now be described in greater detail with reference to the accompanying drawings of which:

FIG. 1 is a section through a burner and mixer assembly,

FIG. 2 shows the heat exchanger assembly and burner assembly in diagrammatic form only and partly in section, FIG. 3 is a section on the line III—III of FIG. 2, FIG. 4 is a horizontal transverse section through a different form of mixer device, FIG. 5 shows in diagrammatic form only part of another gaseous fuel burner embodying the invention, FIG. 6 is a plan view of another form of mixer device, FIG. 7 is a section on the line VII—VII of FIG. 6, FIG. 8 is a plan view of a component of the embodiment shown in FIG. 6, FIG. 9 is a section on the line IX—IX of FIG. 8, FIG. 10 is a plan view of yet another form of mixer device, FIG. 11 is a section on the line XI—XI of FIG. 10, FIG. 12 is a plan view of an alternative form of one of the components of the mixer device, FIG. 13 is a section on the line XIII—XIII of FIG. 12, and FIGS. 14 and 15 are side elevations of further gaseous fuel burners embodying the invention and incorporating mixer devices.

The burner and mixer assembly shown in FIG. 1 has a gas/air mixer 1 comprising an outlet member 2 and an inlet member 3. The bore of the member 2 has a diverging exit portion 4 and a cylindrical portion 5. The portion 5 is located within a cylindrical mounting element 6 having a circular opening 7 in its curved wall and is screw-threaded internally at 8 to receive the inlet member 3 which is appropriately screw-threaded. The inlet member 3 has a bore 9 which is flared downwardly and outwardly as shown.

The cylindrical bore portion 5 has a bevelled edge 10 and the inlet member has a mating bevelled edge 11. The bevelled edge 11 has grooves 12 in it. Each groove has one wall which lies along a line which is tangential to the portion 5 while the other wall lies at angle of about 15° to the tangential wall. In addition, the bevelled surface 10 is upwardly inclined at an angle of about 50° to the horizontal.

The cylindrical bore portion 5 is recessed to receive a ring 13 with sharply bevelled ends and slightly oversize lengthwise so that when the inlet member 3 is screwed into the outlet member 2 slight deformation of the ring 13 takes place and fluid tight joints are obtained between the ring 12 and the inlet and outlet members 3, 2. Th grooves 12 are sufficiently deep to ensure that the deformation of the ring does not result in objectionable blockage of the grooves.

Secured in the opening 7 is a supply pipe 14 whose function will be described later.

The outlet member 2 is telescopically engaged with the cylindrical extension 15 of a diffuser cone 16 which forms the burner mouth and which is contoured at 17 to receive a diffuser head 18 through which passes a passageway 19 with an inlet 20 and an outlet 21 and which is part of a circulatory path for a cooling fluid.

The diffuser head may be a porous plug which has a multiplicity of passageways each providing a flame orifice in the outer surface of the diffuser head.

In use, the supply pipe 14 is joined to a source of combustible gas whilst the inlet member 3 is open to the atmosphere. Gas entering pipe 17 flows through grooves 12 which impart to the streams flowing through them a helical motion which produces within the bore of the oulet member 2 a vortex having an upward component of motion towards the diffuser head 18. The creation of the vortex produces a low pressure region in the vicinity of the axis of the vortex and this induces a flow of air into the mixer device via the open end of the inlet member 3. The air becomes entrained with the streams of gas entering via grooves 12 and becomes thoroughly mixed therewith. A degree of turbulence is also created inside the bore which contributes to effective mixing.

The mixed gas-air fuel enters the cone 16 and spreads out to follow the contour of the latter and after passage through the diffuser head 18 is ignited to burn on the surface thereof in a multiplicity of flames of very low profile.

The dimension of the mixer device 1 and the gas pressure are such that the volumes of air and gas are at least in the appropriate stoichiometric ratio so that sufficient air is available for effective combustion.

The cooling of the diffuser head eliminates the transfer of heat from the burner flames to the cone 16 and any adjacent structure as well as to gaseous fuel moving upwards towards the diffuser and the temperature of the fuel is limited to a value at which light back does not occur. In addition, back pressure is reduced and burn down is eliminated. Reduction of back pressure allows adequate aeration of the gas to be maintained.

It will be appreciated that air necessary for effective combustion is all supplied as primary air and no secondary aeration of the flames is necessary. This implies that the flame height can be minimised and there is no flame mantle. Small flame height enhances cross lighting during ignition and also reduces ignition noises.

FIG. 2 shows a burner embodying the invention incorporated in a heat exchanger assembly for a gas-fired water heater.

The assembly includes a gas burner having a mixer device 22 of the construction described above which is joined by a mouthpiece 22*a*, to a diffuser cone 23 which forms the burner outlet and is contoured as at 24 to receive a diffuser which, in this embodiment, is in the form of a series of finned pipes of which one, 25, is seen in the drawings. The pipe lie in parallel, side-by-side relationship in a common plane. The pipes have fins which do not extend very far from the pipe surface. In this way, the pipes are close together, and the maximum fin temperature is never greatly in excess of the temperature of the cooling fluid-water — which flows through the pipes when the burner is operating. The ends of the pipes terminate in headers 26, 27 there being an outlet 28 from header 27 and a connector 29 which joins header 26 to one end of a finned pipe 30. The pipe 30 is one of a second series of parallel, side-by-side pipes which together form the heat exchanger 31 of the assembly. The second series of pipes lies above and in close proximity to the pipes in the burner mouth being separated from the latter pipes by a space 32 which constitutes a combustion zone. The second series of pipes has a water inlet 33.

Located above the heat exchanger 31 is an exhaust cone 34 through which combustion products pass to atmosphere.

The construction so far described operates in the following manner. Combustible gas is fed into the mixer device 22 via entry pipe 35 in the manner explained above and the resulting air/gas mixture passes through the diffuser head via the flame ports formed between the fins and pipes of the diffuser head and burns in the combustion zone 32 with extremely short flames. The finned pipes such as pipe 25 extract heat partly by radiation and partly by conduction from the closely adjacent flames which, in effect, seat on the fins of the pipes.

The heat exchanger 31 extracts heat from the products of combustion which flow through the spaces between the finned pipes and is also heated by radiation from the closely adjacent flames.

The area of cooling surface provided in the heat exchanger 31 and in the diffuser head is such that condensation of combustion products and the resultant deleterious corrosion is avoided.

The heat exchanger assembly allows a greater proportion of radiant heat to be absorbed than in conventional water heaters and this reduces the air temperature in the vicinity of the combustion zone and the temperature of structures adjacent that zone and thus re-radiation from such structures is very small. These factors all contribute to an easing of the problem of thermally insulating the casing for the heater and other components and there is greater freedom in positioning the heater controls.

It will be appreciated that the assembly shown in FIG. 2 has a small top-to-bottom dimension as compared with the equivalent assembly in a conventional water heater. The absence of a combustion chamber as such contributes greatly in this respect.

The components described above are put together to form a rigid assembly and this ensures alignment of the heat exchanger pipes with those of the diffuser and with the gaseous fuel supply conduit.

It is not essential that the mixer device be of generally cylindrical form as is the case with the mixer 1 described above. The cross-section of the mixter transverse to its length may be of elliptical or other form provided this does not militate against the setting up of the vortex referred to above.

In an alternative form of mixer suitable for use in a gaseous fuel burner, the gas is introduced at a point or points lying within the mixer. For example, a gas supply conduit having a plurality of orifices at its end is introduced into the inlet member 3 of the mixer device 1 described above and gas is introduced via the conduit and orifices instead of via the grooves 12. The orifices may be formed in one end wall of the conduit or in a head attached to the conduit. Each orifice emits a stream of gas and because of the orientation of the orifices the streams are tangential to a circle drawn about the longitudinal axis of the mixer and are inclined towards the upper end thereof to produce the vortex configuration referred to above. The orifices are so located within the mixer that gas spillage from the lower end of the mixer does not occur. The actual position the orifices occupy along the axis of the mixer is effected by the vortex angle, the internal cross-sectional area of the mixer and the velocity at which the gas enters the mixer.

FIGS. 4 shows alternative arrangements by means of which the gas may be introduced.

In FIG. 4, the mixer comprises a cylindircal tube 36 and, in one of the embodiments shown, a series of pipes 37 extend radially into the tube 36. Each pipe 37 has a closed end 38 and, adjacent that closed end, an orifice 39 orientated to direct gas into the tube 36 tangentially to a circle 40 lying inside the tube 36, and with an inclination towards the upper end of the tube through which the air/gas mixture exits to the burner. The pipes 37 need not occupy the diametrically-opposed systems shown in FIG. 3, although, in general, equal spacing of the pipes is advantageous. A smaller or greater number of pipes 37 can be used and they may have orifices tangential to circles of different radii and the orifices may occupy differential positions along the axis of the mixer.

FIG. 4 shows, in chain dotted lines, another position which the pipes might occupy. In this case only the pipe is shown and it projects through the wall of the tube 36 along a chord thereof and into the tube for a short distance. At its end, the pipe 41 has an orifice 42 in its end wall, the orifice being orientated to lie tangentially to the cricle 40 or to some other circle lying inside the tube 36, the orifice also having the necessary inclination towards the relevant end of the tube 36. Several such pipes 41 will normally be used and they may direct fluid tangentially to circles of differing radii. Alternatively, the pipes 41 may themselves be inclined towards the axis of the tube 36. It will be understood that the pipes 41 need not project through the wall of the tube 36 and into the interior thereof but could terminate at the wall, the orifices lying, in effect, in the inside face of the wall. However, by spacing the orifices improved mixing of gas and air is possible.

It will be appreciated that a combination of pipes 37 and 41 may be used and may occupy different positions along the axis of the tube.

It is not necessary that burner head and mixer device be in telescoped close-fitting engagement as in the embodiment described above with reference to FIG. 1. An end-to-end fitting could be used or indeed, the burner and the mixer device may be spaced apart to permit entry of further primary air. Such an arrangement is shown in FIG. 5 in which only part of the burner is shown and the mixer device is shown as a block 42. The burner 43 has the general form described above with reference to FIG. 1, but the diffuser cone 44 is open-ended as shown with a flared or belled mouth 45 in which is located the upper end of the mixer device 42. The mixer device 42 operates in the manner of the mixer device described above, and the gas/air mixture leaving the device entrains further air as indicated by the arrows 46.

Other forms of mixer device will now be described with reference to FIGS. 6–13.

The embodiment shown in FIGS. 6–9 comprises an outer open-ended sleeve 51 within which is coaxially positioned an assembly 52 comprising inner and outer members 53, 54 nested to form an internal annular space 55 access to which is provided by a radial extension 56 of the outer member 54. Secured, for example by screwing, to the extension 56 is a connector 57 which passes through an aperture in the wall of the sleeve 51 so enabling the assembly 52 to be attached to and located within the sleeve 51, the assembly being spaced from the sleeve by an annular gap 58.

The outer member 54 has a flange 59 at one end, the inner face 60 of the flange being formed to provide a series of grooves 61 that are inclined with respect to the axis of the member 54 by an angle lying within the range 35°–60° and preferably about 45°. The other end of member 54 is contoured to fit closely the slightly-belled end of the inner member 53. The other end of the member 53 is sized to fit tightly against the face 60 of the flange 59. As can be seen from FIG. 7, the axial lengths of the members 53 and 54 are equal so that with the members in the positions shown in FIG. 7, a series of orifices is formed in the end surface of the assembly 52 uppermost in FIG. 7.

The device shown in FIGS. 6–9 can be used to mix air and gas and the connector 57 is joined to a source of gas. In use, gas emerges from the orifices as a series of jets which, because of the inclination of the grooves 61, establish a vortex within the sleeve 51. The axis of the vortex coincides substantially with that of the assembly 52 and the region of low pressure within the vortex around that axis causes air to be drawn in through the inner member 53. The slightly converging internal configuration of the member 53 produces an increase in the velocity of the air so drawn in and this helps to maintain the generally upward movement of the air-gas flow.

In addition, air is drawn in through the annular passageway 58 and thus the jets of gas are in intimate contact with a central core of air entering via the inner member 53 and an outer sheath of air entering via the passageway 58. In this way a large volume of air is drawn into the upper part of the sleeve 51 and mixed effectively with the streams of gas.

In the embodiment shown in FIGS. 10 and 11, there is included a sleeve 62 having a bore with a portion 63 of constant internal diameter and a second portion 64 whose bore diverges with increasing distance from portion 63. The lower (as seen in FIG. 11) end of the sleeve is stepped to receive one end of an assembly, similar to assembly 52 described above except that the outer member 54 is stepped at 65 to mate with the correspondingly contoured end of the sleeve 62.

The lower end of the sleeve 62 is also castellated, the gaps of the castellations being indicated at 66. Alternatively, the sleeve may be formed with a series of apertures or "windows" disposed circumferentially adjacent its lower end.

When the components are assembled as shown in FIG. 11, the gaps 66 of the castellations or the windows are so located that they lie adjacent the orifices formed in the end wall of the assembly 2 uppermost in FIG. 11.

The embodiment shown in FIGS. 10 amnd 11 operates in a manner generally similar to the embodiment of FIGS. 6–9. Extension 56 is joined to a source of gas, and gas emerges from the orifices as a series of jets to establish a vortex within the sleeve 62. Air is drawn in through the inner member 53 by the low pressure zone within the vortex to provide the inner core of air described above and also through the gaps 66 to provide an outer sheath of air.

It is not essential that the grooves 61 be formed in the outer member 54. The grooves could, alternatively, be formed in the inner member 53 and FIGS. 12 and 13 show such an alternative form of inner member.

As is shown in FIGS. 12 and 13, the upper (as seen in the Figures) end of inner member 67 has an outwardly extending shoulder 68 grooved at intervals round its periphery as indicated at 69. The grooves are inclined at an angle lying within the range 35°–60° preferably about 45° to the axis of the member 53. The outer member co-operating with an inner member of the form shown in FIGS. 12 and 13 incorporates a flange similar to flange 59 descried above but which has a plain inner face that is not grooved as is the face 60 of the flange 59.

An assembly with an inner member of the form shown in FIGS. 12 and 13 can be used in the embodiments of FIGS. 6–9 and FIGS. 10 and 11 instead of the assembly 52.

The inner and outer members of the assemblies described above may be, for example, die cast in aluminium, the grooves being subsequently accurately sized by a suitable machining operation. Alternatively, after the members are put together the grooves can be sized by a swaging, the size being measured by passing air through the assembly. For example, a ball-ended tool is forced into th bore of the inner member 2 compressing the entrance thereof to an extent ncessary to ensure the correct groove depth as determined by the air flow measurement.

Whilst the mixing devices described above with respect to FIGS. 6–13 can be used to mix fluids, the devices are primarily intended to form mixing devices for incorporation in gaseous fuel burners, the fluids then being gas and air as described above. The device may be fitted to a burner head which seats directly on the upper (as seen in the drawings) end of the sleeves 51 or 62 or alternatively the burner head may have an entrance adapted to receive the mixed gas-air output of the mixer device and to permit the ingress of an additional supply of air drawn from the atmosphere. Ingress may be permitted via a series of holes in the entrance adjacent the mixer device output, or by spacing the entrance from the mixer device. A construction of the latter form is shown diagrammatically in FIG. 14.

The head of the burner shown in FIGS. 14 and 15 is of the construction described above with reference to FIG. 1, that is, it includes a diffuser positioned in the mouth of the burner head, the diffuser having a path therethrough for the circulation of a cooling fluid.

FIG. 14 shows an arangement in which burner head 70 has a belled entrance 71. Located centrally with respect to the entrance 71 is a mixing device 72 which may be of any of the forms described above. Positioned in the mouth of the burner head 70 is a diffuser comprisng a plurality of finned water pipes indicated in FIG. 14 by the block 73. The device 72 operates in the manner described above, the mixture of gas and air issuing from the upper (as seen in FIG. 14) end of the device passing into the entrance 71, entraining as it does so a further supply of air as indicated by the arrows in FIG. 14.

For burners of greater thermal output, it may be necessary to employ two or more mixer devices and FIG. 15 shows a burner employing two mixer devices 74, 75 supplying a common burner head 75.

I claim:

1. A mixer device for mixing first and second fluids, the device comprising a hollow vessel having two open ends and a longitudinal axis and comprising in combination first and second tubular members nested together to form the vessel, one of said members having a surface with a plurality of grooves each of which lies in a direction that is both tangential to a cylinder drawn about said axis and inclined towards one end of said vessel, the other of said members having a surface that coacts with said grooved surface to form a plurality of inlets into said cylinder for said first fluid whereby said first fluid is directed into said vessel with a helical motion about said axis and directed towards said one end of said vessel whereby a low pressure zone is created within the helix to draw said second fluid into said vessel via the other end thereof.

2. A mixer device as claimed in claim 1 in which said inlets are linear and lie along lines inclined to the generatrix of said cylinder.

3. A mixer device as claimed in claim 2 in which the angle between each said inlet and said generatrix lies in the range of from 35°–60°.

4. A mixer device as claimed in claim 3 in which said angle is 45°.

5. A mixer device as claimed in claim 1 in which the said tubular members together form an annular supply chamber from which said grooves extend, said chamber having an inlet for said first fluid.

6. A mixer device as claimed in claim 1 in which said one member has a bore that is flared outwardly towards said other end.

7. A mixer device as claimed in claim 1 in which said other tubular member has a bore of venturi configuration.

8. A gaseous fuel burner comprising a burner head with an inlet and a mixer device as claimed in claim 1 for mixing a gaseous fuel and air for supply as a combustible gaseous fuel mixture to said burner inlet.

9. A gaseous fuel burner as claimed in claim 8 and comprising a plurality of gaseous fuel mixture inlets each supplied, in use, with gaseous fuel mixture from a different mixer device.

10. A gaseous fuel burner as claimed in claim 9 in which each mixer device is separated from the respective gaseous fuel inlet of the burner via an air gap for permitting the entrainment of air into the gaseous fuel mixture.

11. A gaseous fuel burner as claimed in claim 8 in which there is located in the mouth of the burner head a gaseous fuel mixture diffuser having a flow path therethrough for the passage of a cooling fluid, said diffuser being in heat exchanging relationship with the gaseous fuel mixture before ignition.

12. A gaseous fuel burner as claimed in claim 11 in which the diffuser comprises a plurality of finned pipes.

13. A gaseous fuel burner as claimed in claim 12 in conjunction with a heat exchanger having a fluid flow path therethrough, said heat exchanger being located in close proximity to said diffuser so as to be heated by flames seated upon said diffuser but spaced therefrom whereby to define a combustion zone for said flames.

14. An assembly as claimed in claim 13 and further comprising an interconnection from said fluid flow path in said heat exchanger to said flow path through said diffuser to permit fluid to flow through both said fluid flow paths.

15. A mixer device for mixing first and second fluids comprising an open-ended tubular mixing chamber and means at or adjacent one end of the chamber for inspirating the second fluid into the chamber, the means including a supply header for the first fluid, the header comprising inner and outer members forming a header of generally annular form and having a surface generally coaxial with the longitudinal axis of the chamber, and a series of orifices in the surface formed between cooperating surfaces on the inner and outer members, the orifices being disposed radially inwardly with respect to the inner surface of the chamber to form a passage to allow second fluid to enter the chamber between the orifices and said inner surface, said orifices being orientated in such manner that first fluid entering the chamber via the orifices has imparted to it a helical motion about the longitudinal axis and directed towards the other end of the chamber whereby second fluid is inspirated into the chamber through the supply header and from outside the header into the chamber at points adjacent said orifices.

16. A mixer device as claimed in claim 15, in which the supply header is located at the one end of the mixing chamber and in which the mixing chamber is gapped or formed with holes at locations close to the orifices to permit entry into the chamber of second fluid between the apertures and the inner surface of the chamber.

17. A mixer device naurted at the inlet of a diffuser of a burner element for mixing first and second fluids comprising an open-ended tubular mixing chamber and means for inspirating the second fluid into the chamber, the means including a supply header for the first fluid, the header being of generally annular form and having a surface coaxial with the longitudinal axis of the chamber and facing one of the open ends thereof, and a series of orifices in the surface and in communication with the interior of the header, the latter being positioned coaxially within the chamber in such manner that there is an annular passageway between the header and the chamber for the entry into the latter of second fluid, the orifices being spaced radially inwardly with respect to the inner surface of the chamber and being orientated in such manner that first fluid entering the chamber from the orifices has imparted to it a helical motion about said longitudinal axis and directed towards said one open end whereby second fluid is inspirated into the chamber through the supply header and through said annular passageway.

18. A mixer device as claimed in claim 1, in which the vessel formed by said nested tubular members is an open-ended tube, and in which said open-ended tube is coaxially housed in a further open-ended tube, said members being spaced from said further tube to provide an annular passageway between the members and the further tube for the entry into the latter of second fluid.

19. A mixer device as claimed in claim 1, in which said nested components form a tubular mixing chamber that is attached to a second tubular mixing chamber at one end thereof, the second mixing chamber having inlets to permit entry of second fluid into the said second chamber between the latter and said inlets for said first fluid.

* * * * *

UNITED STATES PATENT OFFICE

CERTIFICATE OF CORRECTION

PATENT NO. : 4,033,714

DATED : July 5, 1977

INVENTOR(S) : Alfred Longworth

It is certified that error appears in the above-identified patent and that said Letters Patent are hereby corrected as shown below:

[30] Foreign Application Priority Data

Great Britain - 17691/72 - April 17, 1972

Great Britain - 47926/72 - October 18, 1972

Great Britain - 13583/73 - March 21, 1973

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*